US006010321A

United States Patent [19]

Forsythe et al.

[11] Patent Number: 6,010,321

[45] Date of Patent: Jan. 4, 2000

[54] ROTARY MOWER SPINDLE AND HYDRAULIC MOTOR

[75] Inventors: Frederick E. Forsythe, South Beloit; Chad D. Nelson, Machesney Park, both of Ill.

[73] Assignee: Haldex Barnes Corporation, Rockford, Ill.

[21] Appl. No.: 08/974,789

[22] Filed: Nov. 20, 1997

[51] Int. Cl.[7] ..... F01C 21/04

[52] U.S. Cl. ..... 418/102; 418/181; 418/206.7; 418/206.8

[58] Field of Search ..... 418/102, 206.8, 418/206.7, 181

[56] References Cited

U.S. PATENT DOCUMENTS 5,062,259 11/1991 Lipscombe .

*Primary Examiner*—Thomas Denion
*Assistant Examiner*—Theresa Trieu
*Attorney, Agent, or Firm*—Lathrop & Clark LLP

[57] ABSTRACT

A gear motor has a hydraulic oil drain path through bearings which support the spindle and mounted mower blade. The drain path is through two plain bearings and two opposed thrust bearings to a low pressure port located adjacent to the spindle shaft seal. A drain from the low pressure port through one of the hydraulic motor shafts leads to the case drain. A check valve prevents fluid from leaking through the drain should the spindle shaft seal fail. The plain bearings and thrust bearings have a press fit insert in the shape of a cylinder with a planar lip. The cylinder portion of the insert forms the plain bearing and the planar lip of the insert forms the thrust bearings. The bearing insert cylindrical surfaces have two helical grooves which extend across the cylindrical surface to conduct lubricating oil through the plain bearings. The grooves in the plain bearings communicate with similar grooves in the thrust bearings.

20 Claims, 2 Drawing Sheets

ROTARY MOWER SPINDLE AND HYDRAULIC MOTOR

FIELD OF THE INVENTION

The present invention relates to hydraulic motors in general and to hydraulic drive mechanisms for rotary blades in particular.

BACKGROUND OF THE INVENTION

Large tracts of public and private lands are kept mowed during the growing season for aesthetic and safety reasons. The shoulders and median strips of most highways are kept mowed for visibility and appearance reasons. The lawns found in public parks, private estates and institutional grounds are also mowed to maintain an attractive appearance and to reduce insect populations such as jiggers and mosquitoes. Reciprocating blade mowers, such as those used for harvesting crops, are sometimes used to trim turf grass, yet these devices can be hazardous due to their exposed cutting blades. For very fine cutting, such as on golf greens and bent grass turfs, mowers employing gangs of cutting cylinders are sometimes employed, but proper use is time-consuming, and the mowers themselves are subject to jamming and higher maintenance.

Perhaps the most widely used type of mower, both for landscape and roadside mowing, is the rotary blade mower. Where wide areas must be mowed, three or more rotary blade are often used. Belt and pulley blade drive systems can require high maintenance, and safety requires that multiple guards be installed and adjusted. A preferable mower blade rotation system uses hydraulic motors directly mounted to the mower blade spindle to directly drive the rotary blade or blades. The use of hydraulic motors in combination with bearings which are lubricated with hydraulic fluid has proven effective. If the bearings are of the type which does not use ball bearings, the rotors can better withstand the blade striking a solid object such as a rock or sprinkler head.

Various organizations have promulgated standards for rotary mower safety which require the mower blade to be able to survive a sudden stop when a steel rod is suddenly placed in the path of the blade near the blade tip. These "stake tests" are designed to simulate the mower blade striking a solid object, and the ability of a mower spindle to withstand such a test is indicative of mower safety and durability. Mower reliability is enhanced by increasing the amount of lubricating fluid which passes through the bearings. Hydraulic motors operate on high pressure hydraulic fluid which, if not properly drained from the bearings, can develop high pressures in the bearings which will blow the shaft seal.

What is needed is an improved hydraulic motor and mower blade spindle which has good bearing lubrication and which prevents pressure buildup behind the spindle shaft seal.

SUMMARY OF THE INVENTION

The hydraulic motor and mower spindle of this invention employs a gear motor which has a hydraulic oil drain path through the bearings to the spindle on which a mower blade is mounted. The drain path is through two plain bearings and two opposed thrust bearings to a low pressure port located adjacent to the spindle shaft seal. A drain from the lower pressure port through one of the hydraulic motor shafts leads to the primary case drain. A check valve prevents fluid from leaking through the drain should the spindle shaft seal fail.

The check valve eliminate any catastrophic leakage of oil from a hydraulic reservoir connected to the case drain and drastically reduces the rate of oil leakage should the shaft seal fail. The plain bearings and thrust bearings are formed by a porous bearing insert the shape of a cylinder with a planar lip. Two press-fit inserts form opposed thrust bearings and spaced apart plain bearings. The cylinder portions of the inserts form the plain bearings, and the planar lips of the inserts form the thrust bearings. The bearing insert cylindrical surfaces have two spiral grooves which extend across the cylindrical surface to conduct lubricating oil through the plain bearings. The grooves in the plain bearings communicate with similar grooves in the thrust bearings.

It is an object of the present invention to provide a hydraulic motor and mower blade spindle with improved wear characteristics.

It is a further object of the present invention to provide a hydraulic motor and motor blade spindle with improved durability.

It is another object of the present invention to provide a hydraulic motor and mower blade spindle which is less prone to loss of the spindle shaft seal.

Further objects, features and advantages of the invention will be apparent from the following detailed description when taken in conjunction with the accompanying drawings.

DESCRIPTION OF THE PREFERRED EMBODIMENT

Figure 1:
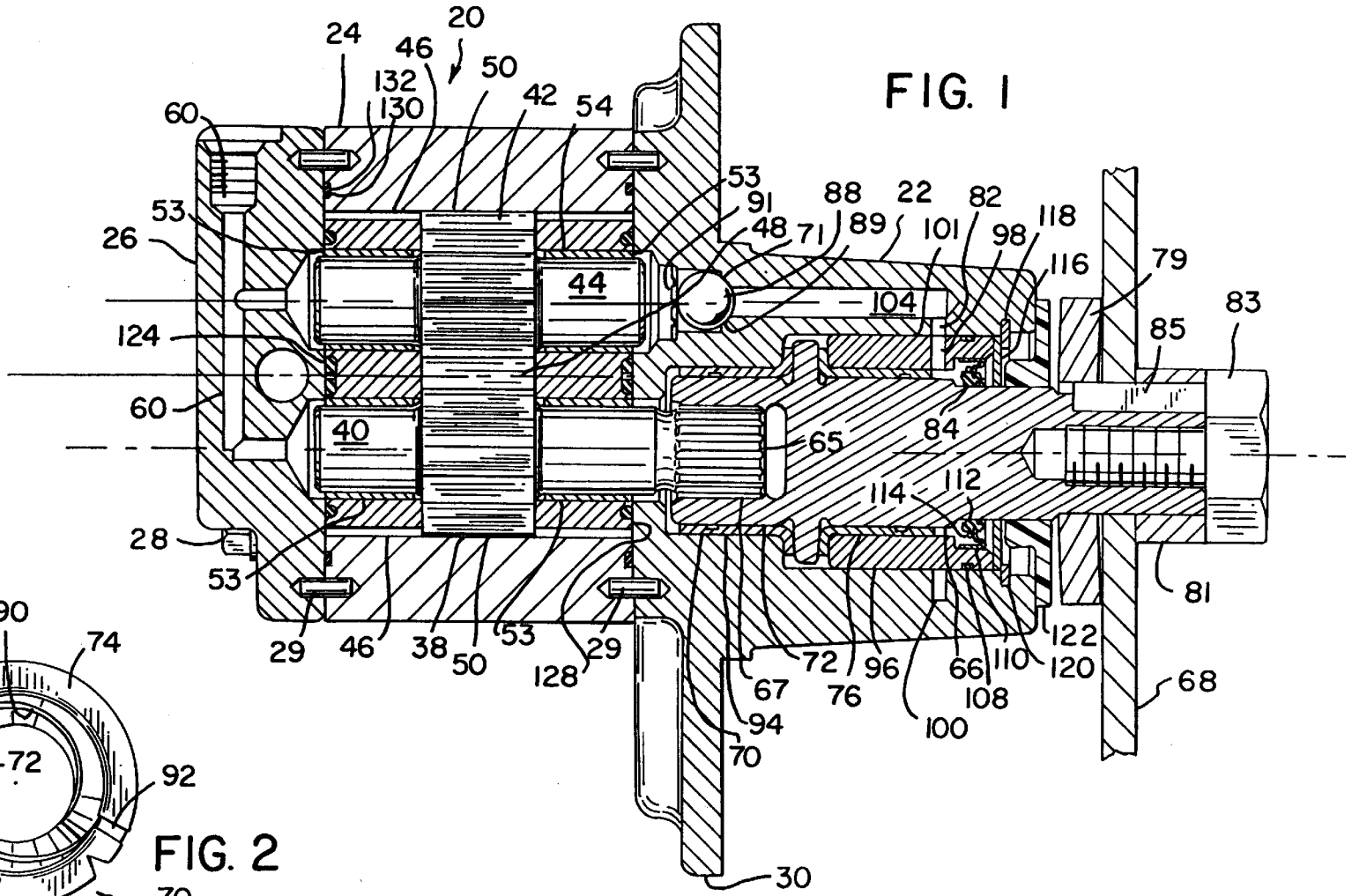
FIG. 1 is a cross-sectional view of the hydraulic motor and mower spindle of this invention.
Figure 2:
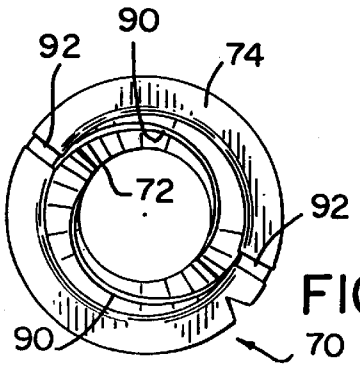
FIG. 2 is an exaggerated perspective top view of a bearing insert of the apparatus of FIG. 1.
Figure 3:
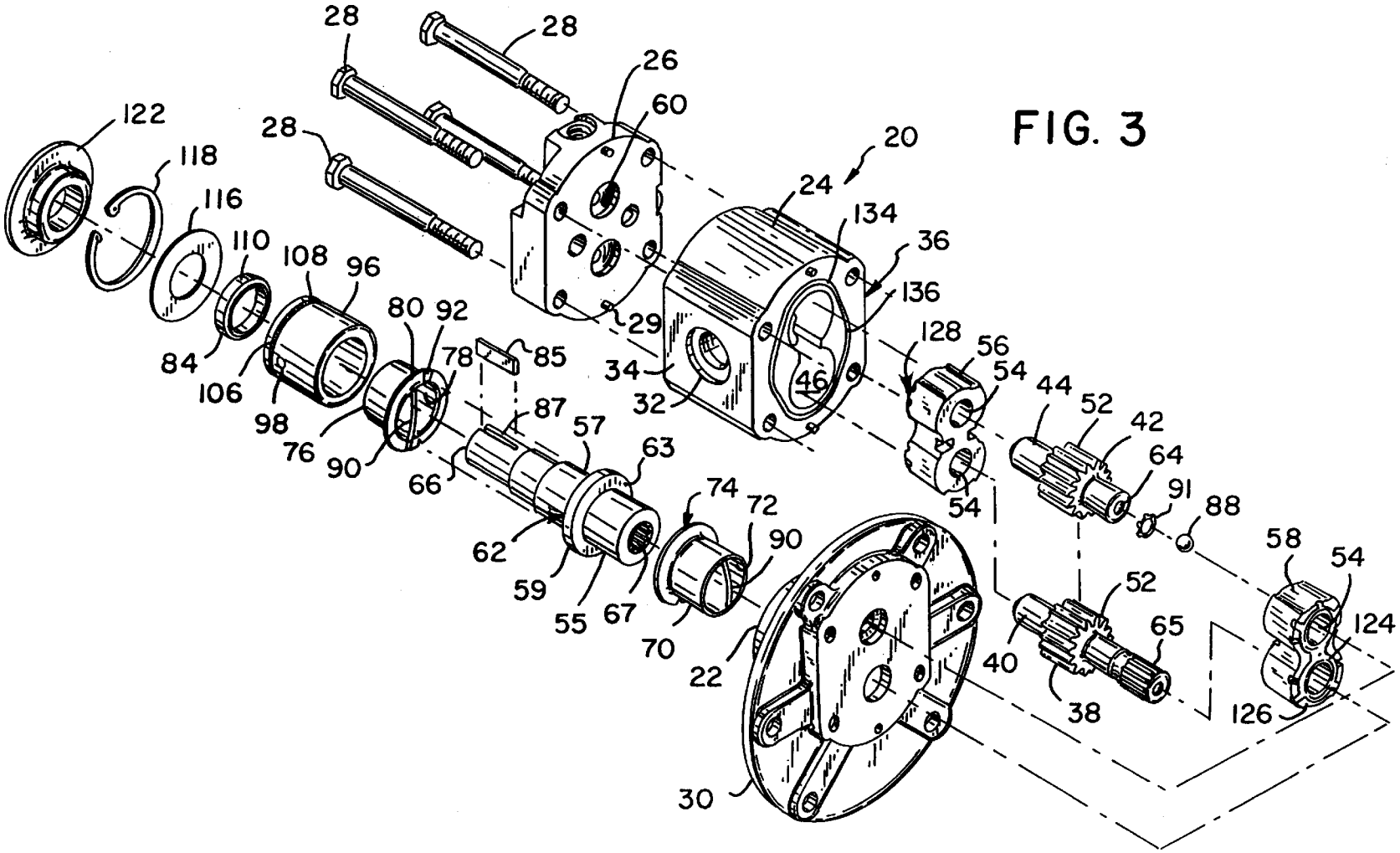
FIG. 3 is an exploded isometric view of the hydraulic motor and mower spindle of FIG. 1.

Referring more particularly to FIGS. 1–3, wherein like numbers refer to similar parts, a hydraulic motor 20 is shown mounted to a spindle housing 22 in FIG. 1. The hydraulic motor 20 has an end cover 26 which is connected to a gear housing 24 by four bolts 28 which engage with the flange 30 of the spindle housing 22.

Pins 29 assure correct alignment between the end cover 26, the gear housing 24, and the spindle housing 22. Fluid enters the gear housing 24 through a hydraulic fluid inlet 32 on an inlet side 34, and exits through a hydraulic fluid outlet (not shown) on an outlet side 36 opposite the fluid inlet 32. A first gear 38 on a first gear shaft 40 meshes with a second gear 42 on a second gear shaft 44 within a twin lobed passageway 46 in the gear housing 22. The intermesh gears 38, 42 form the hydraulic gear motor 20.

In order to pass industry standard tests, in which a mower blade is brought to a sudden stop against a steel rod, a mower blade must have a bearing support which can withstand high torque loads. This is accomplished by using plain thrust and plain journal bearings. Plain bearings are preferred under these test conditions, because journal bearings and thrust bearings which use balls or rollers tend to deform when subjected to high impact loadings. To effectively lubricate the plain bearing, a pressure drop across the bearing has to be created to cause oil to flow through the bearing to lubricate it.

The hydraulic motor 20 is driven by high pressure hydraulic oil which is introduced into the fluid inlet 32 and which passes through to an outlet (not shown) thus causing the gears 38, 42 to rotate. Because there is little volume contained between the gears at the region of intermeshing 48, very little work is performed by the fluid pressure on the gear teeth 52 as they rotate towards the hydraulic fluid inlet 32. Nevertheless, the passage of fluid around the outsides 50 of the gears 38, 40 acts on the gear teeth 52 to produces a force times a distance which represents the power output of the motor 20. For a typical mower application the motor 20 will develop about five to six horsepower with a pressure drop of between 300 to 500 psi.

The hydraulic motors 20 within a single mower will typically be connected in series so that a total oil pressure of 2,000 psi would be used to drive four to six motors. The advantage of driving the hydraulic motors in series is a reduction in the number of hydraulic fluid lines and a balancing of power. In such an arrangement, each motor 20 is forced to operate at a predetermined speed by the volumetric flow of hydraulic fluid. The pressure drop across each motor controls the amount of power developed by that motor. In this way if one motor is more highly loaded more power is supplied to that motor by the resulting higher pressure needed to keep the motor turning at the predetermined speed.

The gear shafts 40, 44 are supported on bearing bushings 53 which are press fit within the shaft bores 54 of the bearings blocks 56, 58 located above and below the gears 38, 42. The bearing bushings 53 have narrow grooves (not shown) which extend parallel to the gear shafts 40, 44 the grooves allow oil to leak along the gear shafts to lubricate the bearing bushings 53 which form the shaft bearings which support the rotation of the motor gears 38, 42 on their shafts. This oil leakage is drained to a case drain 60 formed in the end cover 26. Hydraulic oil which drains along the bearing shafts 40, 44 towards the spindle housing 22 cannot reach the case drain 60 directly but must pass up through an axial hole 64 formed along the axis of the second gear shaft 44.

The first gear shaft 40 has a spline 65 which connects with a spline socket 67 in a downwardly extending spindle shaft 66. Oil drains down along the gear shaft 40 to lubricate bearings which support the spindle shaft 66 within the spindle housing 22. A mower blade 68, shown in FIG. 1, is mounted to the spindle shaft by a washer 79, a spacer 81, and a bolt 83. A key 85 extend within a keyway 87 to lock the blade 68 to the spindle shaft 66.

The spindle shaft 66 is supported on a first bearing 70 which combines a cylindrical bearing surface 72 with a thrust bearing surface 74, the combined bearing being referred to as a flanged bearing. A second bearing 76 is identical to the first bearing 70 and likewise has a cylindrical bearing surface 78 and a thrust bearing surface 80. The spindle shaft 66 has a first cylindrical bearing surface 55 which bears on the first bearing cylindrical bearing surface 72. A second spindle shaft cylindrical bearing surface 57 bears on the second bearing cylindrical bearing surface 78. The spindle shaft 66 has a radially extending flange 59 with two opposed thrust bearing surfaces 63 and 62. The upper bearing surface 63 engages the first thrust bearing surface 74 and the lower thrust bearing surface 62 rides on the second thrust bearing surface 80.

In order to establish an oil pressure gradient through the spindle bearings 70, 76 the spindle housing 22 has an oil drain port 82 positioned near the spindle shaft seal 84. The drain port 82 is connected through a passage 104 which leads to the hole 64 formed along the axis of the second gear shaft 44 which connects to the motor case drain 60. The case drain 60 is connected to a hydraulic reservoir (not shown) maintained at low pressure.

A check valve 71 is formed by a ball 88 positioned to engage a seat 89 incorporated in the drain pathway from the drain port 82. The check valve ball 88 is retained by a washer 91. The check valve 71 provides one-way flow of oil through the bearings 70, 76 to the case drain 60. The check valve 71 is necessary to prevent leakage of oil from the hydraulic reservoir (not shown) which is connected to the case drain 60, if the mower spindle shaft seal 84 fails. The check valve eliminate any catastrophic leakage of oil from a hydraulic reservoir connected to the case drain and drastically reduces the rate of oil leakage should the shaft seal fail.

In order to increase the flow of oil through the spindle bearings 70, 76 the standard bearings, for example those available from Garlock Bearing Inc., are modified as shown in FIG. 2, by forming two generally helical grooves 90 on the cylindrical bearing surfaces 72, 78 and two radial grooves 92 on the thrust bearing surfaces 74, 80. The grooves 90, 92 are about three millimeters wide and approximately 0.2 millimeters deep. The bearings 70, 74 are constructed on a sintered porous material with a DU surface coating and can be run without lubrication, but have significantly better performance and life if lubricated. Bearings without balls or rollers are critical to the ability of the spindle to withstand the severe loading conditions produced when the blade strikes a rock or other solid object. An adequate flow of hydraulic fluid through the bearings 70, 76 increases their life. The grooves 90, 92 also prevent excess pressure from building up between the spindle shaft 66 and the motor housing 24 by accommodating a greater flow of hydraulic oil to the case drain 60. This prevents a buildup of pressure against the spindle 66 which could force the spindle shaft 66 out of the housing 22.

The first bearing 70 is press-fit within a recess 94 in the spindle housing 22. The second bearing 76 is press-fit into a generally annular spindle bushing 96. As shown in FIG. 1, the spindle bushing 96 has a radial hole 98 which extends from a region adjacent the spindle to an encircling circumferential slot 100 in the spindle housing 22. The radial hole forms part of the drain port 82. The circumferential slot 100 extends radially outwardly from a spindle cavity 101 defined by the spindle housing 22. The circumferential slot is positioned adjacent to the radial hole 98 and connects to the radial oil drain port 82 which leads to an axial passageway 104 within the spindle housing which is terminated by the valve seat 89. The spindle bushing 96 has an O-ring groove 106 with an O-ring 108 therein which seals the spindle bushing 96 in the spindle cavity 101. The shaft seal 84 comprises a metal ring 110 which is bonded to a resilient seal 112 and a circumferential spring 114 which biases the resilient seal towards the spindle shaft 66. The outside diameter of the metal ring 110 is bonded to the spindle bushing 96.

A washer 116 overlies the shaft seal 84 and the bushing 96, the washer is retained by a snap-ring 118 positioned in a groove 120 in the spindle housing 22. A cover cap 122 provides a barrier against the introduction of dirt into the spindle shaft bearings.

Figure-eight shaped gaskets 124 positioned on the outwardly facing sides 126 128 of the bearing blocks 56 prevent oil from flowing directly between the shafts 40, 44. An O-ring 130 is positioned in an O-ring groove 132 on the motor housing 24 which prevents oil leakage between the housing and the end cover 26. Similarly, an O-ring 134 is positioned in an O-ring groove 136 to prevent oil leakage between the motor housing 24 and the spindle housing 22.

Under ordinary operating conditions, hydraulic fluid under pressure is introduced to the gears within the gear housing and, after contributing to the rotation of the spindle, discharged to a subsequent gear motor or returned to the hydraulic reservoir. A small fraction of the hydraulic fluid driving the gear motor leaks along the gear shafts and enters the spindle housing at the splined connection between the driving gear shaft and the spindle. The continual inflow of hydraulic fluid along the spindle drives fluid along the plain bearings and along the axial and spiral grooves in the plain bearings, the bearings being thereby lubricated. The hydraulic fluid is allowed to escape from the spindle cavity through a single radial hole in the spindle bushing and from there to the circumferential cavity in the spindle housing and through the oil drain port 82 and the passageway 104 through the check valve 71 and from there to the case drain. This continual lubrication supports extended wear life of the mower.

It should be understood that the term plain bearing refers to a bearing without balls or rollers. A journal bearing refers to a bearing which surrounds a shaft and has a generally cylindrical shape. A thrust bearing is a bearing generally arranged radially about a shaft which supports thrust loads along the shaft. Thrust bearing and journal bearings can be combined in bearings with angled surfaces which perform both functions.

It is understood that the invention is not limited to the particular construction and arrangement of parts herein illustrated and described, but embraces such modified forms thereof as come within the scope of the following claims.

We claim:

1. A hydraulic motor and spindle with improved spindle bearing lubrication comprising:

a hydraulic motor housing;

a first shaft extending within the hydraulic motor housing, wherein a first motor element is located on the first shaft;

a second shaft extending within the hydraulic motor housing, wherein a second motor element is located on the second shaft, the first motor element and the second motor element forming part of a hydraulic motor;

a spindle housing connected beneath the motor housing;

a spindle extending with the spindle housing and connected in driven relationship to the first shaft, the spindle having at least one thrust bearing surface and at least one cylindrical bearing surface;

a plain journal bearing mounted on the spindle housing and engaging the cylindrical bearing surface on the spindle;

a plain thrust bearing mounted on the spindle housing and engaging the thrust bearing surface on the spindle;

portions of the hydraulic motor positioned about the first shaft and above the second shaft which define a case drain which communicates with the spindle housing through a passage defined by portions of the second shaft; and portions of the spindle housing forming a passageway extending beneath the journal bearing and the thrust bearing and communicating with the second shaft passage.

2. The hydraulic motor and spindle of claim 1 further comprising a check valve positioned in the passageway, the check valve oriented to allow fluid to flow only towards the case drain.

3. The hydraulic motor and spindle of claim 2 wherein the check valve is formed by a ball which engages a seat formed by portions of the spindle housing.

4. The hydraulic motor and spindle of claim 1 further comprising:

a second plain journal bearing mounted on the spindle housing and engaging a cylindrical bearing surface on the spindle; and a second plain thrust bearing mounted on the spindle housing and engaging the a second thrust bearing surface on the spindle.

5. The hydraulic motor and spindle of claim 1 further comprising a blade mounted to the spindle.

6. The hydraulic motor and spindle of claim 1 wherein the plain journal bearing has a cylindrical bearing surface defining an axis and wherein the bearing has portions forming a groove which extends across the cylindrical bearing surface in a direction parallel to the axis.

7. The hydraulic motor and spindle of claim 6 wherein the thrust bearing has a radially extending bearing surface and portions of the thrust bearing define a radially extending groove in the bearing surface.

8. The hydraulic motor and spindle of claim 1 further comprising:

portions of the plain journal bearing defining a helical slot which extends around the cylindrical bearing surface of the spindle; and portions of the plain thrust bearing defining a radial slot which extends closely spaced from the thrust bearing surface of the spindle.

9. The hydraulic motor and spindle of claim 1 wherein the thrust bearing and the journal bearing are unitary.

10. An apparatus for rotation of a rotary mower blade comprising;

a housing;

a first shaft with a first gear thereon extending within the housing;

a second shaft extending within the housing and having a second gear thereon which intermeshes with the first gear such that when hydraulic fluid is introduced under pressure into the housing the first shaft is urged to rotate;

a spindle extending within the housing and engaged with the second shaft to be rotated by rotation of the first shaft, the spindle extending downwardly below the first shaft and having an axially extending portion and a radially extending flange portion;

a plain journal bearing mounted to the housing to engage and support in rotational engagement the spindle axially extending portion;

a plain thrust bearing mounted to the housing to engage the spindle radially extending portion;

portions of the housing which define a circumferential slot which encircles the spindle;

a bushing fixed to the housing beneath the spindle radially extending portion, wherein the bushing has portions defining a radially extending passage which extends from a position adjacent the spindle to a position adjacent to the housing circumferential slot to allow the flow of hydraulic fluid from a position adjacent the spindle to the circumferential slot; and portions of the housing defining a drain passageway communicating with the circumferential slot and extending to a drain, wherein a small portion of the hydraulic fluid introduced to the first gear and the second gear flows along the spindle and between the bearings and the spindle to lubricate the rotation of the spindle within the housing, and said small portion of hydraulic fluid flows away from the spindle through the bushing passage, the circumferential slot, and the drain passageway.

11. The apparatus of claim 10 further comprising:

portions of the plain journal bearing defining a helical slot which extends around the axially extending portion of the spindle; and portions of the plain thrust bearing defining a radial slot which extends closely spaced from the spindle radially extending portion.

12. The apparatus of claim 10 further comprising a check valve positioned in the drain passageway, the check valve oriented to allow fluid to flow only towards the drain.

13. The apparatus of claim 10 further comprising:

a second plain journal bearing mounted on the spindle housing and engaging a second axially extending portion on the spindle; and a second plain thrust bearing mounted on the spindle housing and engaging a second a radially extending flange portion on the spindle.

14. The hydraulic motor and spindle of claim 10 further comprising a blade mounted to the spindle.

15. The hydraulic motor and spindle of claim 10 wherein the plain journal bearing has a cylindrical bearing surface defining a axis and wherein the bearing has portion forming a groove which extends across the cylindrical bearing surface in a direction parallel to the axis.

16. The hydraulic motor and spindle of claim 10 wherein the thrust bearing has a radially extending bearing surface and portions of the thrust bearing define a radially extending groove in the bearing surface.

17. The hydraulic motor and spindle of claim 12 wherein the check valve is formed by a ball which engages a seat form by portion of the spindle housing.

18. The hydraulic motor and spindle of claim 10 wherein the thrust bearing and the journal bearing are unitary.

19. A hydraulic motor and spindle with improved spindle bearing lubrication comprising:

a hydraulic motor housing;

a first shaft extending within the hydraulic motor housing, wherein a first motor element is located on the first shaft;

a second shaft extending within the hydraulic motor housing, wherein a second motor element is located on the second shaft, the first motor element and the second motor element forming part of a hydraulic motor;

a spindle housing connected beneath the motor housing;

a spindle extending within the spindle housing and connected in driven relationship to the first shaft, the spindle having at least one thrust bearing surface and at least one cylindrical bearing surface;

at least one plain bearing mounted on the spindle housing and engaging the spindle, the bearing providing rotary and thrust support to the spindle;

portions of the hydraulic motor positioned about the first shaft and above the second shaft which define a case drain which communicates with the spindle housing through a passage defined by portions of the second shaft; and portions of the spindle housing forming a passageway extending beneath the journal bearing and the thrust bearing and communicating with the second shaft passage.

20. The hydraulic motor and spindle of claim 19 further comprising at least two plain bearings providing rotary and thrust support to the spindle to thereby support axial loads in two different directions.

* * * * *